United States Patent [19]

Hood et al.

[11] Patent Number: 4,613,530

[45] Date of Patent: Sep. 23, 1986

[54] MULTIPLE PANE GLASS UNIT WITH ELECTRICALLY CONDUCTIVE TRANSPARENT FILM FOR USE AS RADIATION SHIELD

[75] Inventors: Thomas G. Hood, San Francisco; Steve M. Vincent, San Jose; Stephen W. Mellentin, Palo Alto, all of Calif.

[73] Assignee: Southwall Technologies, Inc., Palo Alto, Calif.

[21] Appl. No.: 667,234

[22] Filed: Nov. 1, 1984

[51] Int. Cl.[4] ..... E06B 3/24

[52] U.S. Cl. ..... 428/34; 52/171; 52/789; 52/790; 428/922

[58] Field of Search ..... 428/34, 38, 922; 52/171, 788, 789, 790

[56] References Cited

U.S. PATENT DOCUMENTS 2,552,955 5/1951 Gaiser et al. ..... 52/171
3,202,054 8/1965 Mochel ..... 52/171
3,801,418 4/1974 Cornelis et al. ..... 428/38
4,335,166 6/1982 Lizardo et al. ..... 428/34

*Primary Examiner*—John E. Kittle
*Attorney, Agent, or Firm*—Townsend and Townsend

[57] ABSTRACT

A glass unit having at least a pair of glass panes spaced from and on opposite sides of an electrically conductive transparent film in a taut condition. The glass panes are separated by a pair of spacer tubes between which the outer peripheral margin of the plastic film extends. A sealant covers the outer peripheries of the spacer tubes and spans the distance between the outer peripheries of the panes. An electrical lead electrically connected directly or through a wire cloth to the film couples the film to electrical ground. The glass unit is transparent to electromagnetic radiation in the 400 to 700 nm range but opaque to electromagnetic radiation in the range of $10^{10}$ to $10^4$ nm.

9 Claims, 5 Drawing Figures

MULTIPLE PANE GLASS UNIT WITH ELECTRICALLY CONDUCTIVE TRANSPARENT FILM FOR USE AS RADIATION SHIELD

This invention relates to improvements in multiple pane glass window and door units and, more particularly, to a glass unit having a transparent thermally insulating film which also serves as a shield for electromagnetic radiation.

BACKGROUND OF THE INVENTION

In buildings or enclosures, it is desirable to provide windows and doors which allow natural light to enter the building or enclosure which is to be shielded from electromagnetic radiation, such as microwave radiation, yet the window units should be heat insulating while being transparent to visible light. Such buildings or enclosures might be used for housing digital computers or sensitive electronic equipment which could be adversely affected by high or low level radiation in the range from kilohertz frequencies to gigahertz frequencies. Moreover, there exists a security basis in many government and military buildings for shielding the interiors thereof to prevent electronic eavesdropping. The ability to remotely access information through electronic monitoring can be significantly reduced by the use of electronic shielding techniques when combined with properly designed shielded walls, roofs and floors.

Glass panes with electrically conductive films applied directly thereto have been used in the past. However, they have not been used to shield a space from the effects of electromagnetic radiation in certain wavelength ranges.

Until now, there has been no suitable glass unit which allows for shielding yet still allows for the entrance of natural light through a continuous field of vision while insulating from loss or gain of heat within the interior of a building. In the prior art, the use of metal mesh screens fails to allow for continuous viewing through the shielding membrane. Because of this drawback, a need has existed for an improved glass unit which not only serves as a window or door unit but also provides a shield for electromagnetic radiation which would otherwise penetrate the building. The present invention satisfies this need.

SUMMARY OF THE INVENTION

The present invention provides an improved multiple pane glass unit which has means for shielding the interior of a space with which the glass unit is used from the penetration of electromagnetic radiation of a given wavelength range. To this end, the shield means includes an electrically conductive, transparent film mounted in spaced relationship between a pair of spaced glass units transmitted through or reflected from the film yet the glass unit permits natural light to pass into the adjacent space while causing incoming radiation to be directed to ground without entering the space.

In one form of the shield means, an electrical lead is connected directly to the outer peripheral portion of the film of the glass unit, and the lead is connected to ground. In another embodiment of the invention, a wire cloth is coupled to the outer peripheral margin of the transparent film, and the wire cloth is connected to ground either by a single electrical lead or by a continuous grounding around the continuous outer periphery of the wire cloth. In a third embodiment of the invention, the glass unit is provided with metallic outer frame members which are electrically conductive and are coupled by means, such as a wire cloth, to the outer periphery of the transparent film so that the frame members can be coupled by an electrical lead to ground. Thus, the present invention provides the benefits of windows and doors having glass panels transparent to visible light while assuring that electromagnetic radiation, at least in a certain wavelength range, will be blocked from entry into an adjacent space. A typical frequency range of the electromagnetic radiation which is blocked by the glass unit of the present invention is $10^3$ Hz to $10^9$ Hz.

The primary object of the present invention is to provide an improved multiple pane glass unit which allows visible light to pass through while being opaque to certain other electromagnetic radiation which is to be blocked from entry or exit through the glass unit, whereby the glass unit will operate in the normal fashion as a building part yet it will block electromagnetic radiation in a certain frequency range to render the glass unit suitable for a wide variety of applications including applications in which electronic eavesdropping and radiation damage to sensitive electronic equipment are to be avoided.

Other objects of this invention will become apparent as the following specification progresses, reference being had to the accompanying drawings for an illustration of the invention.

IN THE DRAWINGS

Figure 1:
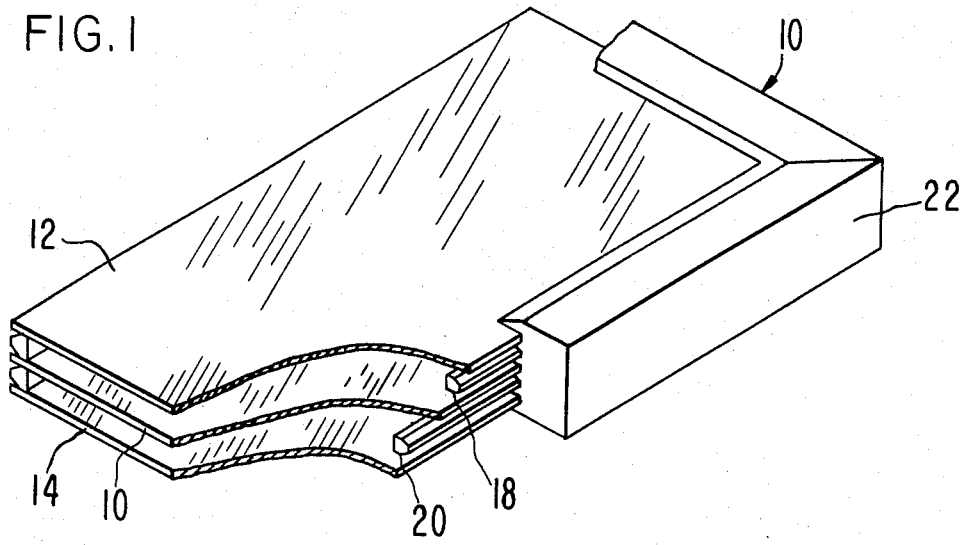
FIG. 1 is a perspective view, partly broken away and in section, of a window unit of the present invention.

The window unit of the present invention is broadly denoted by the numeral 10 and is of the type shown in FIG. 1. Window unit 10 is comprised of a pair of generally parallel, spaced glass panes 12 and 14 and a plastic film or sheet 16 between glass panes 12 and 14, film 16 being generally parallel to glass panes 12 and 14 but spaced inwardly from each pane. The thickness of film 16 in FIG. 1 is slightly exaggerated merely to illustrate the position of the film relative to the panes 12 and 14.

Film 16 is comprised of a clear, polymeric substrate, for example, polyester, with a metallic coating deposited to one or both sides of the substrate. The coating is produced typically by vacuum deposition of materials which results in an optically transparent film in the 400 to 700 nm range (visible region) but which has electrical conductivity sufficient to attenuate electromagnetic energy in the longer wavelength range, $10^4$ to $10^{10}$ nm for example, radio frequencies.

A number of interconnected spacers 18 are between glass pane 12 and the outer peripheral margin of plastic film 16. Similarly, a number of interconnected spacers 20 are between glass pane 14 and the outer peripheral margin of plastic film 16.

Window unit 10 is typically mounted in an outer frame 22 as shown in FIG. 1, whereby the frame supports the window unit for use as a window, door or the like. Frame 22 can be of any suitable construction known in the art, the frame preferably being electrically conductive.

Figure 2:
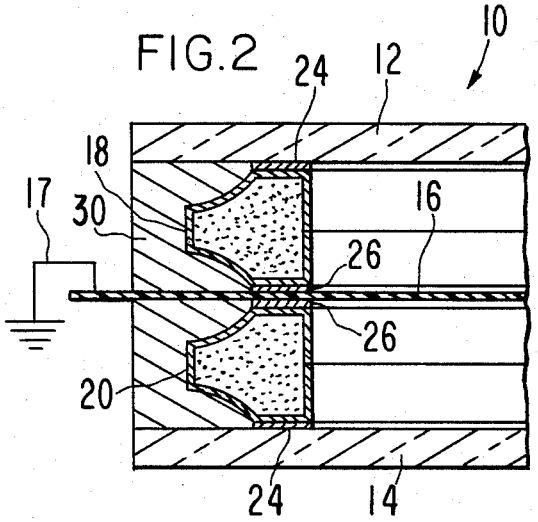
FIG. 2 is an enlarged, fragmentary cross-sectional view of the window unit, showing one embodiment thereof.

Spacers 18 and 20 form respective frames of a rectangular, square or other configuration, and the spacers typically have the cross section shown in FIG. 2. The spacers are hollow to receive an adsorbent material for drying purposes. The adsorbent material is of the type that will absorb water and hydrocarbon vapor. The material may include silica gel, molecular sieves of various porosity (3A and greater), and any mixture of the gel and sieves. Such material maintains a low level of humidity and chemical vapor within window unit 10.

Spacers 18 and 20 form closed tubes which can be of steel, glass-reinforced plastic or aluminum. If formed of steel, each spacer is electro-galvanized and has bonderized surfaces to enhance adhesion thereto of a sealant 30 which can be formed typically from a polyurethane or other material.

Each spacer 18 or 20 has a pair of parallel, flat side surfaces which are in facing relationship to adjacent surfaces of the adjacent pane and the plastic film 16. It may be desirable to seal these side surfaces to the adjacent pane and to the plastic film 16. To this end, layers 24 and 26 of a suitable sealant material are provided between the sides of the spacers and the adjacent panes and the plastic film 16. This sealant typically is polyisobutylene. These sealant layers 24 and 26 can be eliminated, if desired.

As shown in FIG. 2, the continuous outer peripheral margin of film 16 projects through and outwardly from the sealant 30 and an electrical lead 17 electrically couples the film 16 to ground. While a single lead 17 has been shown, it is clear that there could more than one such lead at spaced locations or a continuous electrical conductor about the continuous outer periphery of window unit 10.

Figure 3:
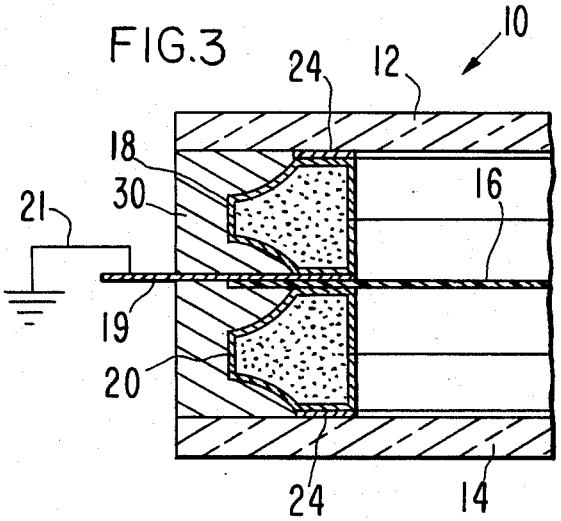
FIG. 3 is a view similar to FIG. 2 but showing a second embodiment of the window unit.

An alternate way of connecting film 16 to ground is by way of the structure of FIG. 3 in which the film 16 does not extend completely through and beyond the sealant 30. Instead, an electrically conductive wire cloth 19 is electrically coupled to the conductive side (if only on one side) of the outer periphery of film 16, and the wire cloth extends through and outwardly from sealant 13 as shown in FIG. 3. An electrically conductive lead 21 connects wire cloth 19 to ground. The wire cloth 19 can be continuous to extend completely about the outer periphery of window unit 10, and a number of electrical leads 21 can be coupled to the wire cloth at spaced locations thereon for grounding the wire cloth at such locations.

Figure 4:
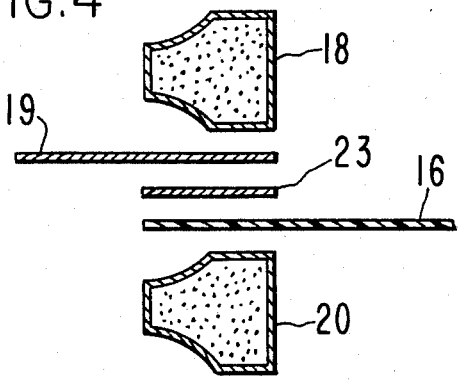
FIG. 4 is a fragmentary, exploded view of a portion of the window unit of FIG. 3, showing the way in which a wire cloth is electrically coupled to a transparent, electrically conductive film forming part of the window unit.

FIG. 4 shows one way in which wire cloth 19 is electrically coupled by a double-sided electrically conductive adhesive tape strip 23 to film 16. In this example, tape 23 is coupled to the conductive side of film 16, assuming only a single side of the film has conductive material thereon. The wire cloth typically has meshes 100–325 and is formed from a suitable electrically conductive material, such as stainless steel, copper or the like. Other ways of electrically connecting film 16 with the wire cloth 19 can be used.

Figure 5:
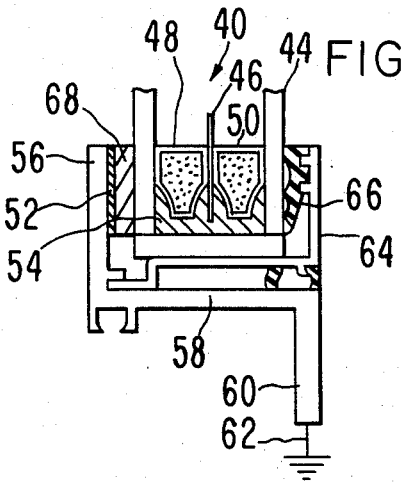
FIG. 5 is a fragmentary, cross-sectional view of a window unit in which the metallic frames of the window unit are used as electrically conductive members.

FIG. 5 shows a window unit 40 which uses the aluminum or other metallic, electrically conductive frame material of the window frame for grounding purposes. To this end, the window unit has glass panes 42 and 44 spaced outwardly on opposed sides of an electrically conductive, transparent film 46 which is clamped between a pair of spacers 48 and 50. A wire cloth 52 makes electrical contact with the outer periphery of film 46 and extends outwardly past glass panes 42 and 44 and then along the inner surface of a portion of a first metallic frame member 56, frame member 56 having segments 58 and 60, segment 60 being connected by an electrical lead 62 to ground. Another frame member 64 is releasably coupled in the conventional manner to frame member 56, and a resilient shim 66 holds the glass panes, spacers and film 46 tightly against a sealing strip 68 of a suitable material, such as butyl. FIG. 5 therefore illustrates the way in which the electrical connection to the transparent, electrically conductive film 16 is made through the metallic members of the window frame itself rather than directly through the direct connection with the outer periphery of film 16 or with a wire cloth as shown in FIGS. 3 and 4.

When aluminum window frame sections are used, the sections which are in contact with the conductive ground plane through lead 62 must also be conductive. If anodizing is used to color treat the window frame members, then masking of these contact sections is required inasmuch as anodized aluminum surfaces are not electrically conductive.

In a typical application, for instance, using the wire cloth concept of FIGS. 3 and 4, a typical sample size of a window frame is 29 inches by 29 inches with a glass thickness of $\frac{1}{8}$ inch clear float and a spacer width of $\frac{3}{8}$ inch. The wire cloth can be stainless steel 200 mesh and the conductive adhesive strip 23 (FIG. 4) can be 3M copper-filled tape. Film 16 can have a visible transmission of 58% and surface resistivity of 4 ohms per square. A test standard based upon military specification standard is 285. The results obtained by the use of the foregoing typical parameters are as follows:

| FREQUENCY (Hz) | SHIELDING EFFECTIVENESS ATTENUATION (dB) |
|---|---|
| 100 M | 30.2 |
| 400 M | 35.9 |
| 1000 M | 35.2 |
| 2000 M | 30.0 |
| 10000 M | 36.4 |

Attenuation levels of greater than 30 dB represent the fact that 99.9% and more of the imposing electromagnetic radiation is being rejected, primarily through reflection. The distance d from the source of electromagnetic radiation to window unit 10 determines the shielding effectiveness. The above data represents "far field" shielding as the following definitions apply:

far field $d > \lambda/2\pi$ near field $d < \lambda/2\pi$ where $\lambda$ = wavelength of the radiation In far field applications, the shielding effectiveness is independent of the frequency as shown in the above data. The application of this invention into buildings would deal primarily with far field conditions.

It is also possible that the present invention can perform consistent with or better than the expectations of any insulating glass product with regard to thermal insulation and product durability. The applications for this invention involve buildings, rooms and enclosures where electromagnetic radiation is to be excluded or minimized. The ability to remotely access information through electronic monitoring, for example, can be significantly deterred through the use of the present invention when combined with properly designed shielding walls, roofs and floors.

The present invention allows for the design of enclosures using windows which are transparent to the visible spectrum (400 to 700 nm) but are opaque to electromagnetic energy in the range between $10^{10}$ to $10^4$ nm (approximately $10^3$ Hz to $10^9$ Hz). Thus, the present invention allows for the benefits obtained typically in windows, that is, the entrance of light, shielding of heat and allowance for vision, without jeopardizing the shielding effectiveness of the enclosure or building with which the glass unit is used.

We claim:

1. A glass unit comprising:

a glass pane having an outer periphery;

a transparent, electrically conductive film adjacent to the glass pane and having a continuous outer peripheral margin in proximity to the outer periphery of the pane, there being a space between the pane and the outer peripheral margin of the film;

a sealant in said space; and electrically conductive wire cloth means coupled with the film and extending through the sealant for electrically connecting the film to ground, said wire cloth means being continuous and extending about and in electrically coupled relationship with said outer peripheral margin of the film.

2. A glass unit comprising:

a pair of glass panes;

a pair of spacers between the glass panes to present an internal space between the panes;

a transparent, electrically conductive film in the internal space in a taut condition, said film having a continuous outer peripheral margin between the spacers, said spacers being spaced from and in proximity to the outer peripheries of the panes to present an outer peripheral space;

a sealant in the outer peripheral space; and elongated means extending through the sealant and along and in electrically coupled relationship with said outer peripheral margin of the film for electrically connecting the film to ground.

3. A glass unit as set forth in claim 2, wherein each spacer has a pair of opposed, generally flat sides, there being a first sealant layer between one side of each spacer and the adjacent surface portion of a respective glass pane and a second sealant layer between the other side of each spacer and the adjacent surface portion of the film.

4. A glass unit as set forth in claim 2, wherein the film extends through and outwardly from the sealant, said connecting means extending through the sealant.

5. A glass unit as set forth in claim 4, wherein said connecting means includes a continuous wire cloth and an electrical lead.

6. A glass unit as set forth in claim 2, wherein said connecting means includes a continous wire cloth extending about and in electrical contact with the outer peripheral margin of the film and an electrical lead for coupling the wire cloth to ground.

7. A glass unit as set forth in claim 6, wherein said wire cloth extends through and outwardly of the sealant.

8. A glass unit as set forth in claim 6, wherein the wire cloth extends through the sealant, there being an electrical, doubled-sided adhesive tape coupling the wire cloth to the film, and an electrical lead secured to the part of the wire cloth exteriorly of the sealant.

9. A glass unit as set forth in claim 2, wherein the film is transparent to radiation in the wavelength range of 400 to 700 nm, but substantially attenuates radiation in the wavelength range of $10^4$ to $10^{10}$ nm.

* * * * *